US009354609B2

(12) United States Patent
Born et al.

(10) Patent No.: US 9,354,609 B2
(45) Date of Patent: May 31, 2016

(54) SYNCHRONIZATION OF TIMEPIECE RESONATORS

(71) Applicant: The Swatch Group Research and Development Ltd., Marin (CH)

(72) Inventors: Jean-Jacques Born, Morges (CH); Jean-Luc Helfer, Le Landeron (CH); Jerome Favre, Neuchatel (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 14/847,090

(22) Filed: Sep. 8, 2015

(65) Prior Publication Data

US 2016/0091863 A1 Mar. 31, 2016

(30) Foreign Application Priority Data

Sep. 29, 2014 (EP) ..... 14186911

(51) Int. Cl.

| | |
|---|---|
| ***G04B 17/04*** | (2006.01) |
| ***G04B 17/10*** | (2006.01) |
| ***G04B 18/04*** | (2006.01) |
| ***G04B 15/02*** | (2006.01) |

(52) U.S. Cl.

CPC ..... *G04B 18/04* (2013.01); *G04B 15/02* (2013.01); *G04B 17/04* (2013.01); *G04B 17/10* (2013.01)

(58) Field of Classification Search

CPC ..... G04B 15/02; G04B 17/00; G04B 17/02; G04B 17/04; G04B 17/08; G04B 17/10; G04B 18/04

See application file for complete search history.

(56) References Cited

U.S. PATENT DOCUMENTS

| | | | | |
|---|---|---|---|---|
| 22,791 | A | 2/1859 | Fasoldt | |
| 1,232,285 | A * | 7/1917 | Greeley | G04B 15/00 368/132 |
| 3,186,157 | A * | 6/1965 | Favret | G04B 17/066 310/37 |
| 3,600,973 | A * | 8/1971 | Haag | G04B 17/04 368/160 |
| 7,950,846 | B2 * | 5/2011 | Hessler | G04B 17/20 368/127 |
| 2010/0002548 | A1 * | 1/2010 | Hessler | G04B 17/20 368/129 |
| 2013/0070569 | A1 * | 3/2013 | Sarchi | G04F 7/08 368/62 |

FOREIGN PATENT DOCUMENTS

WO WO 2006/067597 A2 6/2006

OTHER PUBLICATIONS

European Search Report issued Mar. 9, 2015 in European Application 14186911, filed on Sep. 29, 2014 (with English Translation).

* cited by examiner

*Primary Examiner* — Vit W Miska

(74) *Attorney, Agent, or Firm* — Oblon, McClelland, Maier & Neustadt, L.L.P.

(57) ABSTRACT

Coupling mobile member for synchronising two resonators, each including an interface pin periodically following a plane, closed trajectory, including grooves for holding the pins equidistant from an axis on a structure subjected to a torque about the axis, on which the grooves are coplanar grooves, radial with respect to the axis, for reception of the pins in symmetrical pairs with respect to a main, straight groove passing through the axis, in a plane perpendicular to the axis, and in which slides a main slide-block, which cooperates with a plurality of bars, each hinged on one side to one of the pins, and hinged on the other side to the main slide-block.

17 Claims, 5 Drawing Sheets

SYNCHRONIZATION OF TIMEPIECE RESONATORS

This application claims priority from European patent application No. 14186911.5 filed Sep. 29, 2014, the entire disclosures of which is hereby incorporated herein by reference.

FIELD OF THE INVENTION

The invention concerns a coupling mobile member for synchronisation of a plurality of timepiece resonators having the same frequency and each including an interface pin arranged to transmit a torque to its respective resonator, and each said interface pin periodically following a plane, closed trajectory, wherein said coupling mobile member includes, integral with a structure that pivots about a pivot axis and includes torque receiving means, means for holding said pins at an equal distance from said axis.

The invention also concerns a movement including, mounted on a main plate by means of its fixed elements, at least one such balanced resonator.

The invention also concerns a watch including a movement of this type.

The invention concerns the field of timepiece resonators.

BACKGROUND OF THE INVENTION

The search for resonator mechanisms with a small number of components, with reduced friction, and with satisfactory isochronism, is a constant preoccupation of timepiece designers.

Resonators of the rotational curvilinear translation type, obtained by placing in series two oscillators having flexible pivots each including one weight suspended relative to another by a plurality of flexible strips, appear to be a promising line of development. However, the principle of such resonators has drawbacks, and in particular the strong reaction at the attachment to the main plate of the movement.

WO Patent Application No 2006/067597 A2in the name of ALLAMAN discloses a pallet lever arranged with several arms, for synchronisation of as many balances having the same frequency which each include a pin cooperating with a fork of each of the arms of the pallet lever, on the same radius with respect to the pivot axis of the pallet lever.

US Patent Application No 22791 A in the name of FASOLDT discloses a mechanism with an escape wheel having two levels, which each cooperate with pallet-stones comprised in as many pallet levers as there are peripheral balances.

SUMMARY OF THE INVENTION

The invention proposes to minimise stress at the attachment of a resonator mechanism to the fixed elements of the movement, such as the main plate, and consequently to ensure the optimum working of the system, and the insensitivity to external stresses, longevity and reliability of such a mechanism.

To this end, the invention concerns a coupling mobile member for synchronisation of a plurality of timepiece resonators having the same frequency and each including an interface pin arranged to transmit a torque to its respective resonator, and each said interface pin periodically following a plane, closed trajectory, wherein said coupling mobile member includes, integral with a structure that pivots about a pivot axis and includes torque receiving means, means for holding said pins at an equal distance from said axis, characterized in that, said holding means include, integral with said structure, a plurality of grooves each substantially radial with respect to said axis, in a plane perpendicular to said axis, for reception of each said pin, said grooves being disposed symmetrically in pairs with respect to a main, straight groove passing through said axis, in a plane perpendicular to said axis, and inside said main groove, a main slide-block slides freely and cooperates with a plurality of bars each arranged to be hinged on one side to one of said pins, and hinged on the other side to said main slide-block.

The invention also concerns a balanced resonator including a plurality of timepiece resonators having the same frequency and each including an interface pin arranged to transmit a torque to its respective resonator, and each said interface pin periodically following a plane, closed trajectory and including such a coupling mobile member arranged to cooperate with said interface pins, characterized in that said coupling mobile member constitutes the only mechanical connection between the moving elements of said resonators.

The invention also concerns a movement including, mounted on a main plate by means of its fixed elements, at least one such balanced resonator.

The invention also concerns a watch including a movement of this type.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
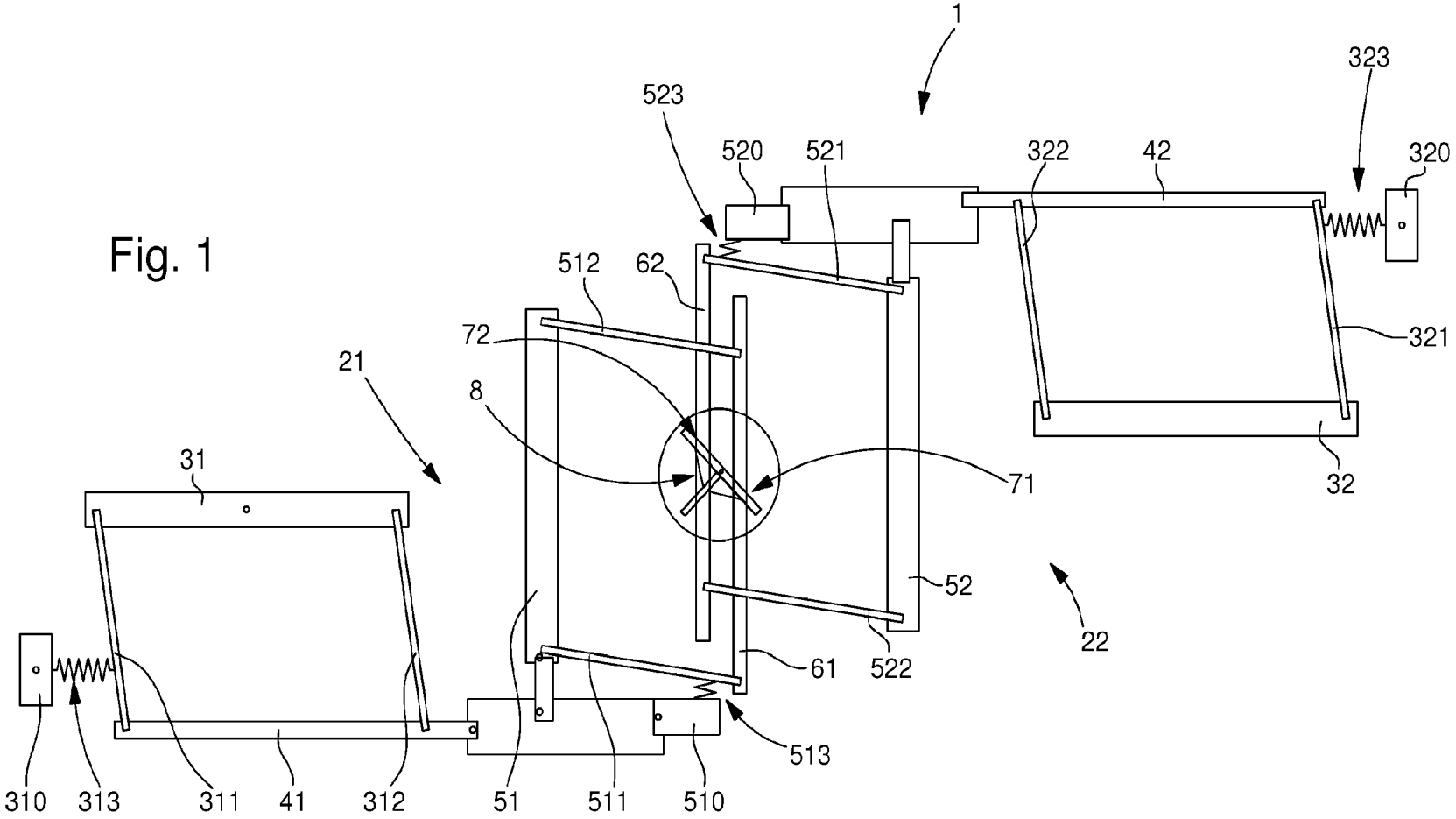
FIG. 1 shows a schematic, front view of a balanced resonator according to the invention, which includes two timepiece resonators which are a first resonator and a second opposite resonator, each of the rotational curvilinear translation type, obtained by placing in series two oscillators having flexible pivots each including one weight suspended relative to another by a plurality of flexible strips, and wherein these two resonators are synchronised by a coupling mobile member according to the invention.

The invention concerns a coupling mobile member 8 for the synchronisation of a plurality of timepiece resonators 21, 22 having the same frequency and each including an interface pin 71, 72 arranged to transmit a torque to its respective resonator 21, 22, and each said interface pin 71, 72 periodically following a plane, closed trajectory.

According to the invention, this coupling mobile member 8 includes a structure 85 mounted to pivot about a pivot axis D, and structure 85 includes means for receiving a torque provided by a timepiece movement 100, such as the torque from a winding barrel, or similar.

This coupling mobile member 8 includes, integral with structure 85, means for holding pins 71, 72 at an equal distance from axis D.

More specifically, in a simple and non-limiting variant embodiment, these holding means include, integral with structure 85, a plurality of grooves 81, 82, each substantially radial with respect to axis D, in a plane perpendicular to axis D, for reception of each such pin 71, 72.

These grooves 81, 82 are disposed symmetrically in pairs with respect to a main, straight groove 94, passing through axis D, in a plane perpendicular to axis D, and inside which a main slide-block 93 slides freely. This main slide-block 93 cooperates with a plurality of bars 91, 92, each hinged on one side to one of pins 71, 72, and on the other side to main slide-block 93. More specifically, these bars 91, 92 are of identical length to each other for each pair of grooves 81, 82 symmetrical to axis D, to restrict pins 71, 72 to symmetrical trajectories with respect to main groove 94.

In a specific embodiment, coupling mobile member 8 is arranged for synchronisation of two such timepiece resonators 21, 22. In a particular embodiment, the two grooves 81, 82 corresponding to pins 71, 72 of these two resonators 21, 22 are straight and aligned with each other and with axis D, to restrict pins 71, 72 to symmetrical trajectories with respect to axis D.

In a particular embodiment, coupling mobile member 8 is arranged for synchronisation of two such identical timepiece resonators 21, 22 mounted symmetrically opposite each other.

The invention also concerns a balanced resonator 1 including a plurality of such timepiece resonators 21, 22, synchronised by such a coupling mobile member 8.

Disregarding the attachment of the fixed elements comprised in resonators 21, 22 and which are connected by the main plate, bridges or suchlike, this coupling mobile member 8 constitutes the only mechanical connection between the moving elements of these resonators 21, 22.

In a particular embodiment, balanced resonator 1 includes two such timepiece resonators 21, 22.

In a particular embodiment, balanced resonator 1 includes at least one timepiece resonator 21, 22 of the rotational curvilinear translation type, obtained by placing in series two oscillators having flexible pivots, each including one weight suspended relative to another by a plurality of flexible strips.

In a particular embodiment, balanced resonator 1 includes two such timepiece resonators 21, 22, each of the rotational curvilinear translation type, obtained by placing in series two oscillators having flexible pivots, each including one weight suspended relative to another by a plurality of flexible strips.

In a particular embodiment, coupling mobile member 8 is arranged for synchronisation of two such timepiece resonators 21, 22, each of the rotational curvilinear translation type, obtained by placing in series two oscillators having flexible pivots, each including one weight suspended relative to another by a plurality of identical, flexible strips, mounted symmetrically opposite each other, as seen in FIG. 1, which illustrates a particular and preferred application of the invention, wherein balanced resonator 1 includes two such rotational curvilinear translation resonators, a first resonator 21, and a second opposite resonator 22.

In this particular and advantageous implementation, the first resonator 21 and second opposite resonator 22 are assembled symmetrically opposite each other.

Disregarding the main plate of the movement, or similar, which supports the fixed elements thereof, coupling mobile member 8 of balanced resonator 1 constitutes the only mechanical connection between the first resonator 21 and the second opposite resonator 22. This coupling mobile member 8 includes or forms a wheel set, such as an escape wheel or similar, subjected to a torque provided by a timepiece movement 100, such as a barrel torque transmitted by a gear train, or similar.

First resonator 21 includes a first fixed weight 31, arranged to be rigidly secured to a fixed structure, main plate or similar, or forming such a main plate.

First resonator 21 also includes a first moving weight 41, which is suspended by first flexible strips 311, 312 (or ball joint bars, which may then be rigid and at least one of which is returned by a spring) from the first fixed weight 31.

In a particular variant, this first moving weight 41, and/or at least one of the first flexible strips 311, 312 (or ball joint bars, which may then be rigid and at least one of which is returned by a spring) is connected by elastic return means 313, such as a spring or similar, to a fixed structure 310.

This first oscillator oscillates essentially in a first linear direction Y. The first moving weight 41 of this first oscillator is integral with a return weight 51 which acts as an anchor for the second flexible strips 511, 512, or ball joint bars, at least one of which is returned by spring, of a second oscillator, which oscillates essentially in a second linear direction X, perpendicular to the first linear direction Y.

This second oscillator of first resonator 21 also includes a second moving weight 61, which is suspended by second flexible strips 511, 512, or ball joint bars, from return weight 51.

This second moving weight 61 includes a first pin 71 arranged to cooperate with coupling mobile member 8, which will be detailed below.

In a similar and symmetrical manner, the second opposite resonator 22 includes a first opposite fixed weight 32, arranged to be rigidly secured to a fixed structure, main plate or similar, or forming such a main plate.

The second opposite resonator 22 also includes a first opposite moving weight 42 which is suspended by first opposite flexible strips 321, 322 or ball joint bars, from the first opposite fixed weight 32.

In a particular variant, this first opposite moving weight 42, and/or at least one of the first opposite flexible strips 321, 322, or ball joint bars, is connected by opposite elastic return means 323, such as a spring or similar, to an opposite fixed structure 320, which may advantageously be fixed structure 310, or the fixed structure or plate to which the first fixed weight 31 and/or the opposite first fixed weight 32 is secured.

This first opposite oscillator essentially oscillates in the same first linear direction Y. First opposite moving weight 42 of this first opposite oscillator is integral with an opposite return weight 42 which acts as anchor for the second opposite flexible strips 521, 522, or ball joint bars, of a second opposite oscillator, which oscillates essential in the same second linear direction X, perpendicular to first linear direction Y.

This second opposite oscillator of second opposite resonator 22 also includes a second opposite moving weight 62, which is suspended by second opposite flexible strips 521, 522 or ball joint bars, from opposite return weight 52.

Second opposite moving weight 62 includes a second opposite pin 72, arranged to cooperate with coupling mobile member 8.

In a particular embodiment, illustrated in the Figures, the oscillations of the components of the first and second oscillators of first resonator 21 are coplanar in a first plane P1, the oscillations of the components of the first and second oscillators of second opposite resonator 22 are coplanar in a second plane P2, which is parallel to first plane P1.

In a particular embodiment, first plane P1 and second plane P2 coincide.

Coupling mobile member 8 is arranged to pivot about a pivot axis D. In a particular and preferred manner, this pivot axis D is perpendicular both to the first linear direction Y and to the second linear direction X. In a particular embodiment, coupling mobile member 8 includes, coaxial to axis D, an external housing 87 of a ball bearing, whose internal housing 86 is integral with an arbor arranged to be mounted between bearings secured to the main plate or similar.

Coupling mobile member 8 includes a first groove 81, substantially radial with respect to axis D, in which first pin 71 moves with minimum play or with friction, between two radial end-of-travel stops, inner stop 810 and outer stop 811, respectively close to and remote from axis D. In a particular embodiment, this first groove 81 is arranged in a first arm 83, which extends in a plane parallel to a coupling plane P9 perpendicular to axis D.

In a particular embodiment, first pin 71 moves with minimum play in first groove 81.

In another particular embodiment, first pin 71 moves with friction in first groove 81, with a substantially constant radial braking force.

Coupling mobile member 8 includes a second groove 82 that is substantially radial with respect to axis D, in which the second opposite pin 72 moves with minimum play or with friction, between two radial end-of-travel stops, inner stop 820 and outer stop 821, respectively close to and remote from axis D. In a particular embodiment, this second groove 82 is arranged in a second arm 84 which extends in a parallel plane to a coupling plane P8 perpendicular to axis D.

In a particular embodiment, second opposite pin 72 moves with minimum play in second groove 82.

In another particular embodiment, second opposite pin 72 moves with friction in second groove 82 with a substantially constant radial braking force.

In a particular embodiment, first groove 81 is straight.

In a particular embodiment, second groove 82 is straight.

In a particular and preferred embodiment, first groove 81 and second groove 82 are aligned with each other and with axis D. Main groove 94 is orthogonal to first groove 81 and to second groove 82.

The movements of first pin 71 in first groove 81 and that of second opposite pin 72 in second groove 82 are not free, but connected by a coupling means which ensures the symmetry of their positions with respect to axis D.

In a particular and preferred embodiment, coupling mobile member 8 includes a third main groove 94. This third main groove 94 is straight, passes through axis D, with which it defines, in projection onto coupling plane P8, an axis of symmetry of first groove 81 and second groove 82.

The third main groove 94 acts as a support for a main slide-block 93, between two radial end-of-travel stops 940 and 941, respectively close to and remote from axis D.

In a particular embodiment, this third main groove 94 is arranged in a third arm 85, which extends in a plane parallel to a coupling plane P8 perpendicular to axis D, and forms the aforecited structure. In a particular embodiment, third arm 85 carries, in its plane, a toothed wheel, particularly an escape wheel, which is not shown to avoid overloading the drawings.

This main slide-block 93 carries, directly or indirectly, a first bar 91 connecting it to first pin 71, and a second bar 92 connecting it to second opposite pin 72. In a particular embodiment, main slide-block 93 carries one or two trunnions 95 receiving the end of first bar 91 and of second bar 92, opposite the corresponding pin 71, 72. These trunnions 95 may be, depending on the arrangement of the assembly, aligned or offset. In a particular, non-limiting embodiment, first bar 91 and second bar 92 are pivotally mounted, at their ends, on first pin 71, second opposite pin 72 and the respective trunnions 95. First bar 91 and second bar 92 are of identical length.

Figure 2:
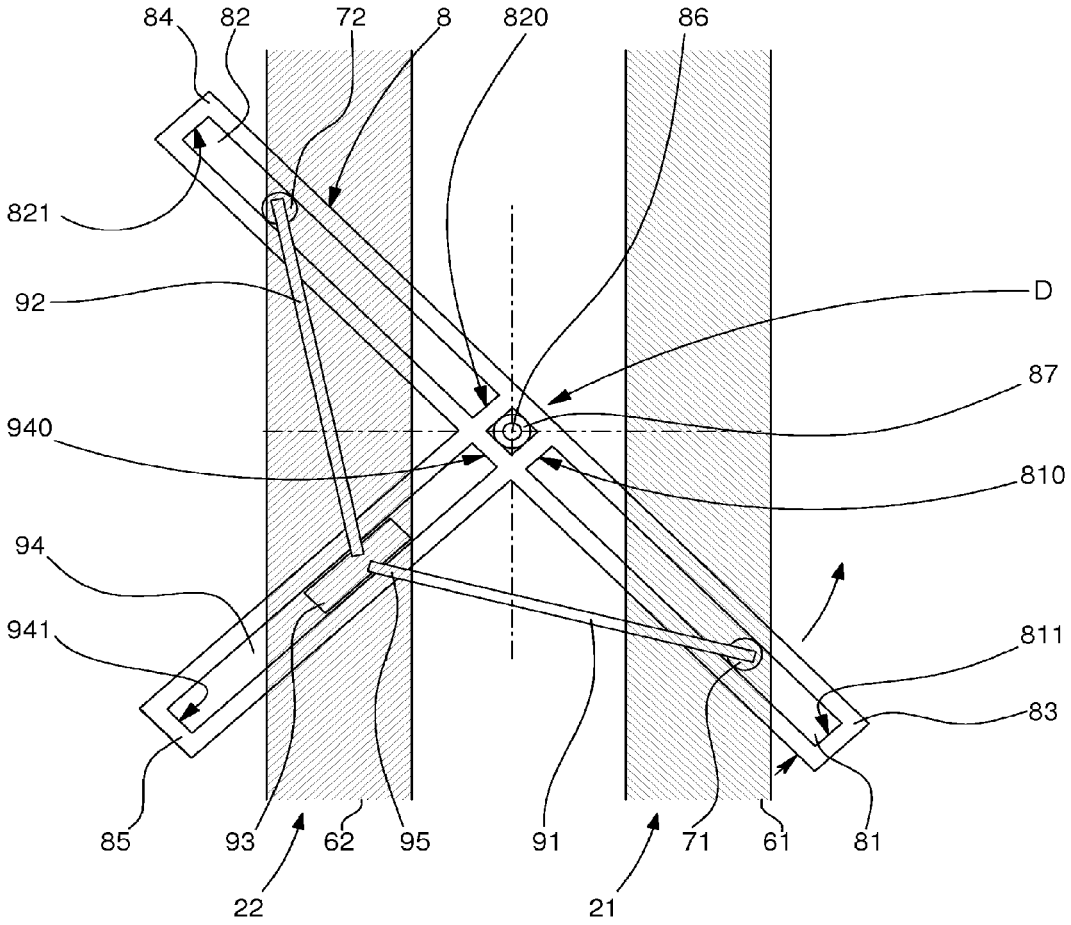
FIG. 2 shows a detail of FIG. 1, detailing the coupling mobile member and its interface with pins comprised in the two resonators.
Figure 3:
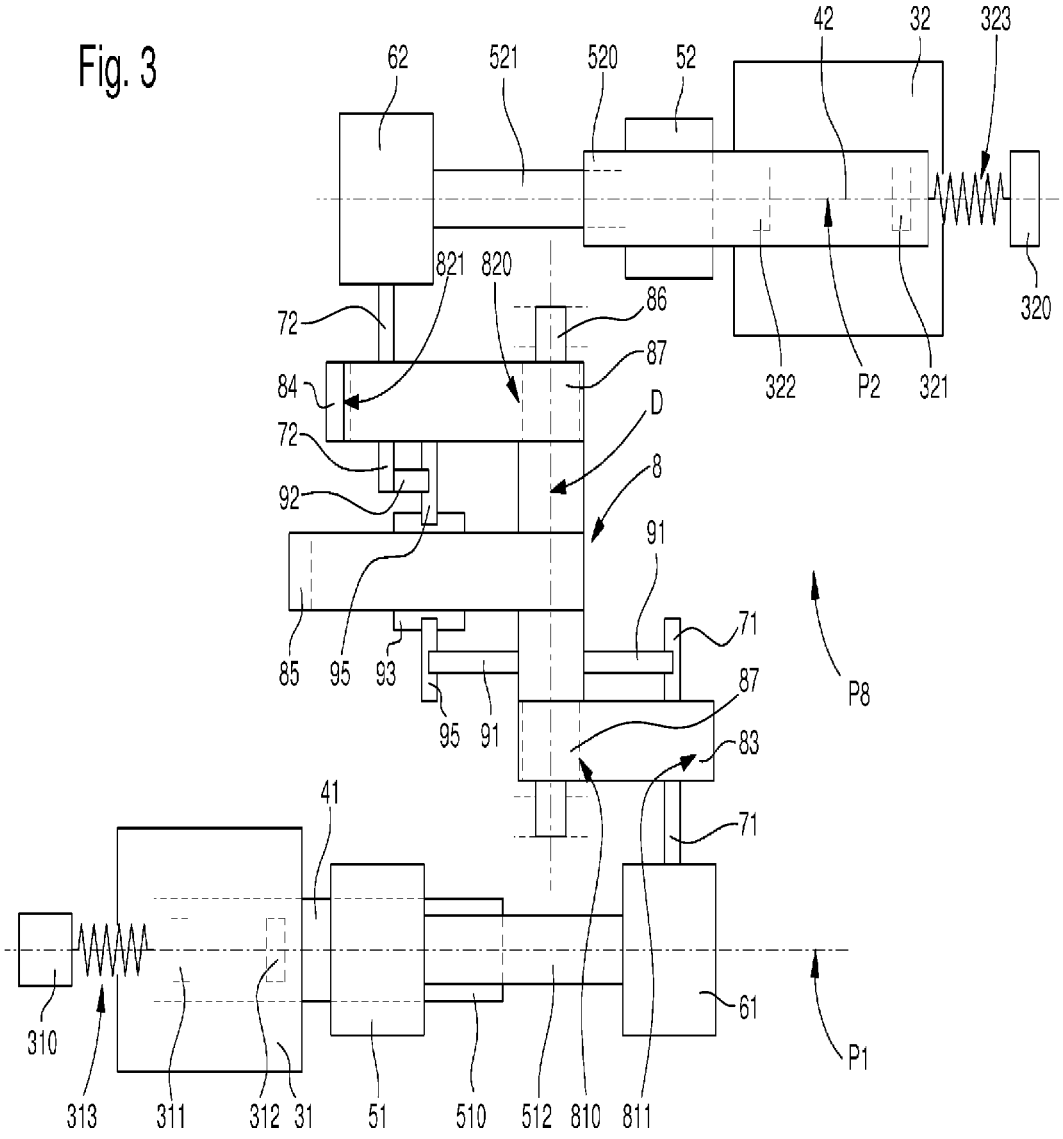
FIG. 3 shows a schematic top view of the balanced resonator of FIG. 1.
Figure 4:
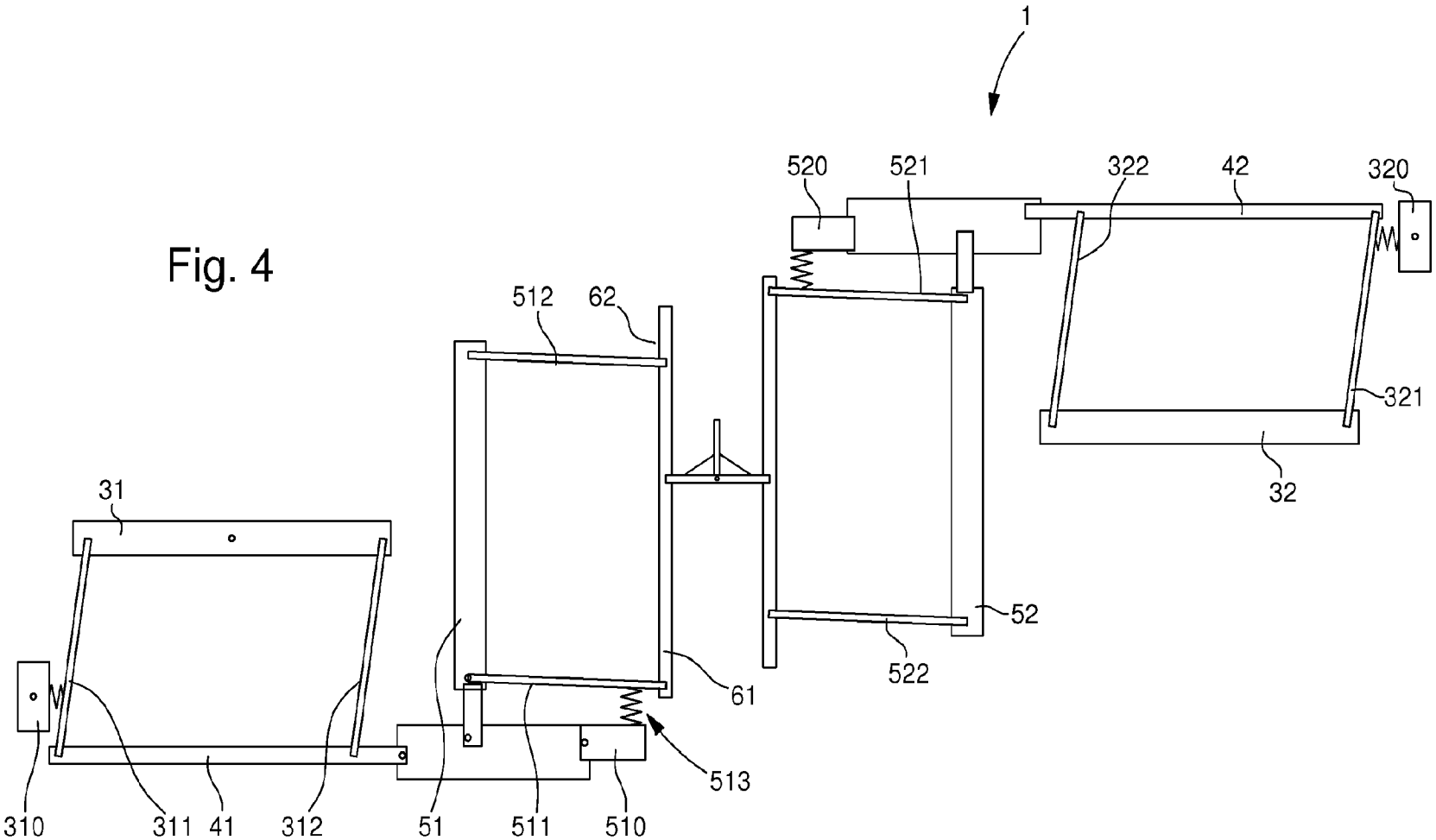
FIG. 4 shows the balanced resonator of FIG. 1, wherein the oscillators forming each of the two resonators occupy different positions, and wherein the coupling mobile member occupies another angular position.
Figure 5:
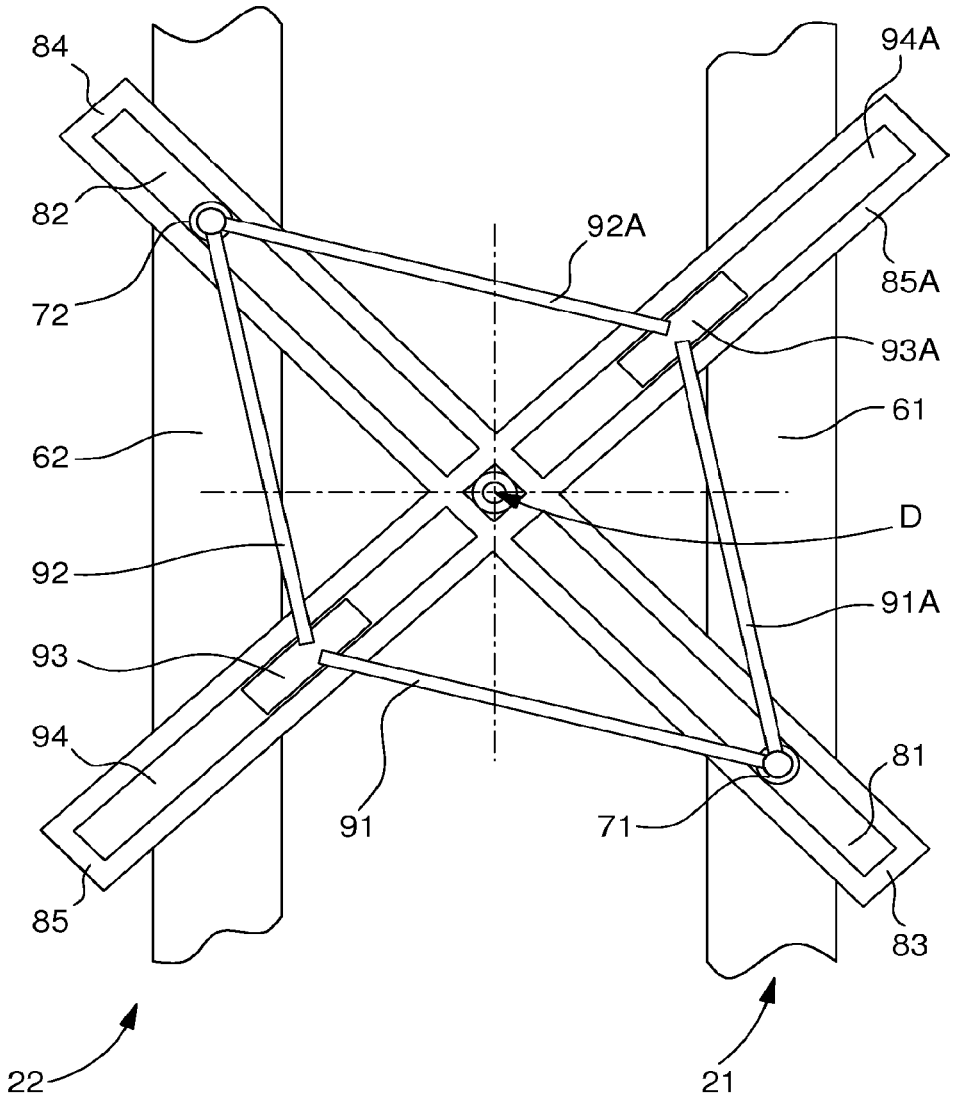
FIG. 5 shows a variant of FIG. 2 with a balanced coupling mobile member to prevent any unbalance.
Figure 6:
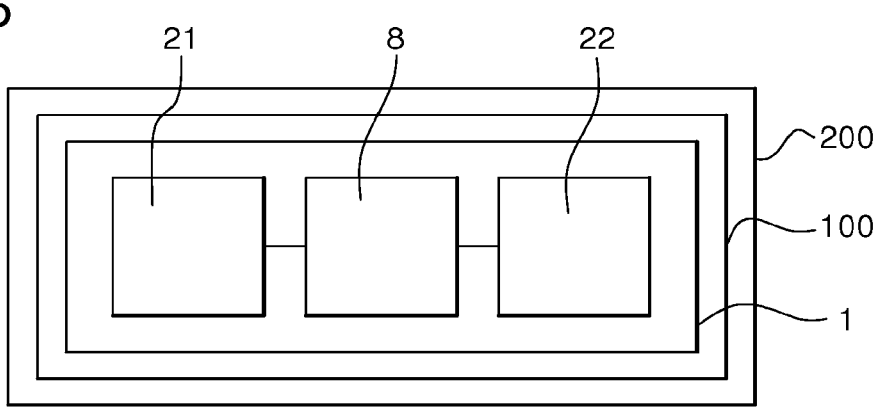
FIG. 6 is a block diagram showing a watch including a movement which integrates a balanced resonator of this type.

Due to this symmetrical construction, first bar 91 and second bar 92 are always in symmetry with respect to the axis of third main groove 94. FIG. 2 illustrates a simplified T-shaped embodiment: FIG. 5 shows a variant of FIG. 2 with a cross-shaped coupling mobile member, balanced to prevent any unbalance, and which includes a fourth arm 85A, symmetrical with third arm 85 with respect to axis D and equipped in the same manner, with a groove 94A, a slide-block 93A, and two arms 91A and 92A hinged to pins 71 and 72.

Wheel set 8 may take any other shape, particularly circular. It is preferably statically and dynamically balanced.

In the actual operation of first resonator 21 and of second opposite resonator 22, first pin 71 and second opposite pin 72 each have a closed, substantially elliptical trajectory, which is even better if it is close to a circular trajectory. In order to prevent each pin 71, 72 going beyond axis D, to allow a trajectory close to a circle, and to facilitate restarting where required, the inner radial end-of-travel stops 810 and 820 are remote from axis D, on the same side as that of the respective outer stops 811 and 821.

In a particular embodiment, first pin 71 is integral with the inner housing of a ball bearing whose outer housing is integral with a first slide-block which slides, with no play or with friction, in first groove 81. In a particular embodiment, this first slide-block slides with friction in first groove 81.

In a particular embodiment, second opposite pin 72 is integral with the inner housing of a bearing whose outer housing is integral with a second slide-block which slides, with no play or with friction, in second groove 82. In a particular embodiment, this second slide-block slides with friction in second groove 82.

In a particular embodiment, each trunnion 95 is integral with the inner housing of a ball bearing whose outer housing is integral with main slide-block 93. In a particular embodiment, this main slide-block 93 slides with friction in the third main groove 94.

The symmetrical arrangement of the invention eliminates the drawback of a strong reaction at the attachment to the main plate, which is characteristic of a resonator with rotational curvilinear translation, obtained by placing in series two oscillators having flexible pivots, each including one weight suspended with respect to another by a plurality of flexible strips and mounted alone.

Coupling mobile member 8 has the advantage of perfectly synchronising first resonator 21 and second opposite resonator 22, and of controlling friction The use of ball bearings or similar on the pivots makes it possible to minimise friction, the presence of friction on the slide-blocks makes it possible to control the shape of the elliptical trajectory of first pin 71 and of second opposite pin 72.

In first resonator 21 as in second opposite resonator 22, return forces are not exactly proportional to motions, since the flexible pivots used in such resonators are very short, which results in a non-linearity of the force of the spring as a function of motion, which introduces an isochronism defect. To make the system isochronous, the respective groove 81, 82 which acts as guide for the respective pin 71, 72 is arranged in a particular manner. In a particular embodiment, each groove 71, 72 is given a shape creating a radial force, which corrects the spring constant variation of the flexible guide strips. This force may be directed towards the centre or outwards, depending on the shape of the groove. A first embodiment is an entirely curved groove. In an advantageous variant, the concavity of this groove 71, 72 decreases gradually away from axis D. In a second embodiment, groove 71, 72 includes a first inner part which is radial with respect to axis D, and tangent to a second curved part of constant or decreasing concavity away from axis D so as to compensate for isochronism defects. In another variant, groove 71, 72 is straight but not radial.

The invention also concerns such a resonator 1 provided with such a coupling mobile member 8, a movement 100 provided with such a resonator and including a main plate carrying the fixed elements of resonator 1, a watch 200 provided with such a movement 100.

What is claimed is:

1. A coupling mobile member for synchronisation of a plurality of timepiece resonators having the same frequency and each including an interface pin arranged to transmit a torque to the respective resonator thereof, and each said interface pin periodically following a plane, closed trajectory, wherein said coupling mobile member includes, integral with a structure that pivots about a pivot axis and includes means for receiving a torque, means for holding said pins at an equal distance from said axis, wherein said holding means of said coupling mobile member include, integral with said structure, a plurality of grooves each substantially radial with respect to said axis, in a plane perpendicular to said axis, for reception of each said pin, said grooves being disposed symmetrically in pairs with respect to a main, straight groove passing through said axis, in a plane perpendicular to said axis, and inside said main groove, a main slide-block slides freely and cooperates with a plurality of bars each arranged to be hinged on one side to one of said pins, and hinged on the other side to said main slide-block.

2. The coupling mobile member according to claim 1, wherein said bars are of identical length to each other for each pair of said grooves symmetrical to axis, to restrict said pins to symmetrical trajectories with respect to said main groove.

3. The coupling mobile member according to claim 1, wherein said coupling mobile member is arranged for synchronisation of two said timepiece resonators and includes two grooves corresponding to said pins, of said two resonators and which are straight and aligned with each other and with said axis, to restrict said pins to symmetrical trajectories with respect to said axis.

4. The coupling mobile member according to claim 1, wherein said coupling mobile member includes a first, substantially radial groove with respect to said axis and including two radial, inner and outer end-of-travel stops for limiting the radial travel of a said pin, said first groove being arranged in a first arm, which extends in a parallel plane to a coupling plane perpendicular to said axis, and in that said coupling mobile member includes a second, substantially radial groove with respect to said axis and including two inner and outer end-of-travel stops for limiting the radial travel of a said pin, said second groove being arranged in a second arm, which extends in a parallel plane to a coupling plane.

5. The coupling mobile member according to claim 4, wherein said first groove and said second groove are straight and aligned with each other and with said axis, and in that said main groove is orthogonal to said first groove and to said second groove.

6. The coupling mobile member according to claim 4, wherein, to prevent each said pin from going beyond said axis, said inner, radial, end-of-travel stops are remote from said axis, on the same side as that of said respective outer stops.

7. The coupling mobile member according to claims 4, wherein said coupling mobile member includes a first slide-block that slides, with no play or with friction, in said first groove and which carries an outer housing of a ball bearing whose inner housing is arranged to receive a said pin and/or in that said coupling mobile member includes a second slide-block which slides, with no play or with friction, in said second groove and which carries an outer housing of a ball bearing whose inner housing is arranged to receive a said pin.

8. The coupling mobile member according to claim 1, wherein said coupling mobile member includes, centred on said axis, an outer housing of a ball bearing that includes an inner housing integral with an arbor arranged to be mounted between bearings secured to a main plate.

9. The coupling mobile member according to claim 1, wherein said coupling mobile member includes or constitutes an escape wheel subjected to a torque provided by a timepiece movement.

10. A balanced resonator including a plurality of timepiece resonators having the same frequency and each including an interface pin arranged to transmit a torque to the respective resonator thereof, and each said interface pin periodically following a plane, closed trajectory and including a coupling mobile member according to claim 1, arranged to cooperate with said interface pins, wherein said coupling mobile member constitutes the only mechanical connection between the moving elements of said resonators.

11. The balanced resonator according to claim 10, wherein said balanced resonator includes two said timepiece resonators.

12. The balanced resonator according to claim 11, wherein said balanced resonator includes at least one timepiece resonator of the rotational curvilinear translation type, obtained by placing in series two oscillators having flexible pivots, each including one weight suspended relative to another by a plurality of flexible strips or ball joint bars at least one of which is returned by a spring.

13. The balanced resonator according to claim 12, wherein said balanced resonator includes two said timepiece resonators, which are a first resonator and a second opposite resonator, each of the rotational curvilinear translation type, obtained by placing in series two oscillators having flexible pivots, each including one weight suspended relative to another by a plurality of flexible strips.

14. The balanced resonator according to claim 13, wherein said first timepiece resonator and said second opposite resonator are identical and assembled symmetrically, one opposite the other.

15. The balanced resonator according to claim 10, wherein said coupling mobile member includes a first said groove, substantially radial with respect to said axis, in which a first said pin of a first resonator moves with minimum play or with friction between two, inner and outer radial, end-of-travel stops, and includes a second said groove, substantially radial with respect to said axis, in which a second said opposite pin of a second said resonator moves with minimum play or with friction, between two inner and outer, radial, end-of-travel stops.

16. A movement including, mounted on a main plate by means of the fixed elements thereof, at least one balanced resonator according to claim 10.

17. A watch including a movement according to claim 16.

* * * * *